United States Patent [19]

McClain et al.

[11] 4,370,098

[45] Jan. 25, 1983

[54] METHOD AND APPARATUS FOR MONITORING AND CONTROLLING ON LINE DYNAMIC OPERATING CONDITIONS

[75] Inventors: James E. McClain; William D. Dickson; Howard L. Scott, all of Greenville, Tex.

[73] Assignee: ESCO Manufacturing Company, Greenville, Tex.

[21] Appl. No.: 198,353

[22] Filed: Oct. 20, 1980

[51] Int. Cl.[3] ..... F04B 49/06

[52] U.S. Cl. ..... 417/18; 417/45; 417/63; 417/43; 417/53

[58] Field of Search ..... 417/1, 12, 18, 20, 22, 417/45, 43, 63, 53

[56] References Cited

U.S. PATENT DOCUMENTS

| | | | |
|---|---|---|---|
| 3,075,466 | 1/1963 | Agnew et al. | 417/12 |
| 3,306,210 | 2/1967 | Boyd et al. | 417/1 |
| 4,108,574 | 8/1978 | Bartley et al. | 417/20 |
| 4,145,161 | 3/1979 | Skinner | 417/22 |
| 4,248,194 | 2/1981 | Drutchas | 417/20 |
| 4,284,943 | 8/1981 | Rowe | 417/53 |
| 4,302,157 | 11/1981 | Welton | 417/44 |

*Primary Examiner*—William L. Freeh

*Attorney, Agent, or Firm*—Kenneth R. Glaser

[57] ABSTRACT

Disclosed are a method and system for monitoring and controlling the normally inaccessible dynamic operating conditions, such as well fluid head and motor terminal voltage, of a well pumping operation, in response to monitored conditions at the top of the well. At the heart of the system is a computer having, stored therein, coded data representative of the fixed well, motor, and pump characteristics and programs defining the mathematical relationship between the stored fixed data, dynamic operating conditions of interest, and the monitored conditions. Feedback control for regulating the well fluid head and motor terminal voltage include the computer and uniquely designed frequency converter and line drop compensator apparatus.

15 Claims, 7 Drawing Figures

METHOD AND APPARATUS FOR MONITORING AND CONTROLLING ON LINE DYNAMIC OPERATING CONDITIONS

This invention relates to the monitoring and control of operating conditions in remotely inaccessible locations, more particularly to the monitoring and control of underground well pumping operatings, and even more particularly to a computer controlled system and related equipment for monitoring and controlling the on line dynamic operating conditions of a well pumping operation.

There are many applications where it is necessary to continuously monitor dynamic (changing) operating conditions of events occurring at relatively inaccessible locations, one such application being in the field of petroleum production. Specifically, the production of crude oil from underground wells typically involves a pumping operation utilizing suspended, submersible motor-driven pumps located thousands of feet below the surface for pumping the petroleum to ground level. During the course of the pumping operation, the well characteristics (fluid head location, well pressure, fluid temperature, etc.), as well as the motor-pump characteristics (RPM, torque, motor temperature, etc.) are subject to continuous change; and in order to maintain safe and efficient well production, it is necessary to continuously monitor (and in many instances, control) these dynamic on line operating conditions. The inaccessability and remoteness of each well head as well as the motor-pump combination contributes to the difficulty of accomplishing this objective.

To date, the monitoring of the dynamic well and pump-motor characteristics has been carried out with the use of a large number of separate and expensive sensors and transducers which are either mounted with the submerged motor-pump combination or suspended into the well. Among the disadvantages of such techniques are the requirement of a large number of separate signal lines or wires extending into the well in order to transmit the downhole data to the outside world, as well as the very critical need to isolate and protect these downhole sensors and transducers from the extremely antagonistic underground environment. The failure of these sensors and transducers can result in not only substantial repair and replacement expense, but extensive loss in oil production during down time.

It is therefore a principal objective of the present invention to provide a new and improved method and apparatus for monitoring and controlling dynamic operating conditions in remotely inaccessible locations.

It is another objective of the invention to provide a new and improved method and apparatus for monitoring and controlling the dynamic on line conditions in an underground well during petroleum production without the employment of separately suspended downhole monitoring sensors or transducers.

It is another objective of the invention to provide a computer-controlled servo-type system for monitoring and controlling specific dynamic on line well and motor characteristics.

It is a still further object of the invention to provide new and improved apparatus, in such system, for altering the frequency of the power supplied to the downhole motor, as well as for maintaining as essentially constant voltage supplied to such motor.

These and other objects, as well as specific features and advantages, of the invention will become more readily understood and appreciated from the following detailed description taken in conjunction with the accompanying drawings, in which.

Figure 1:
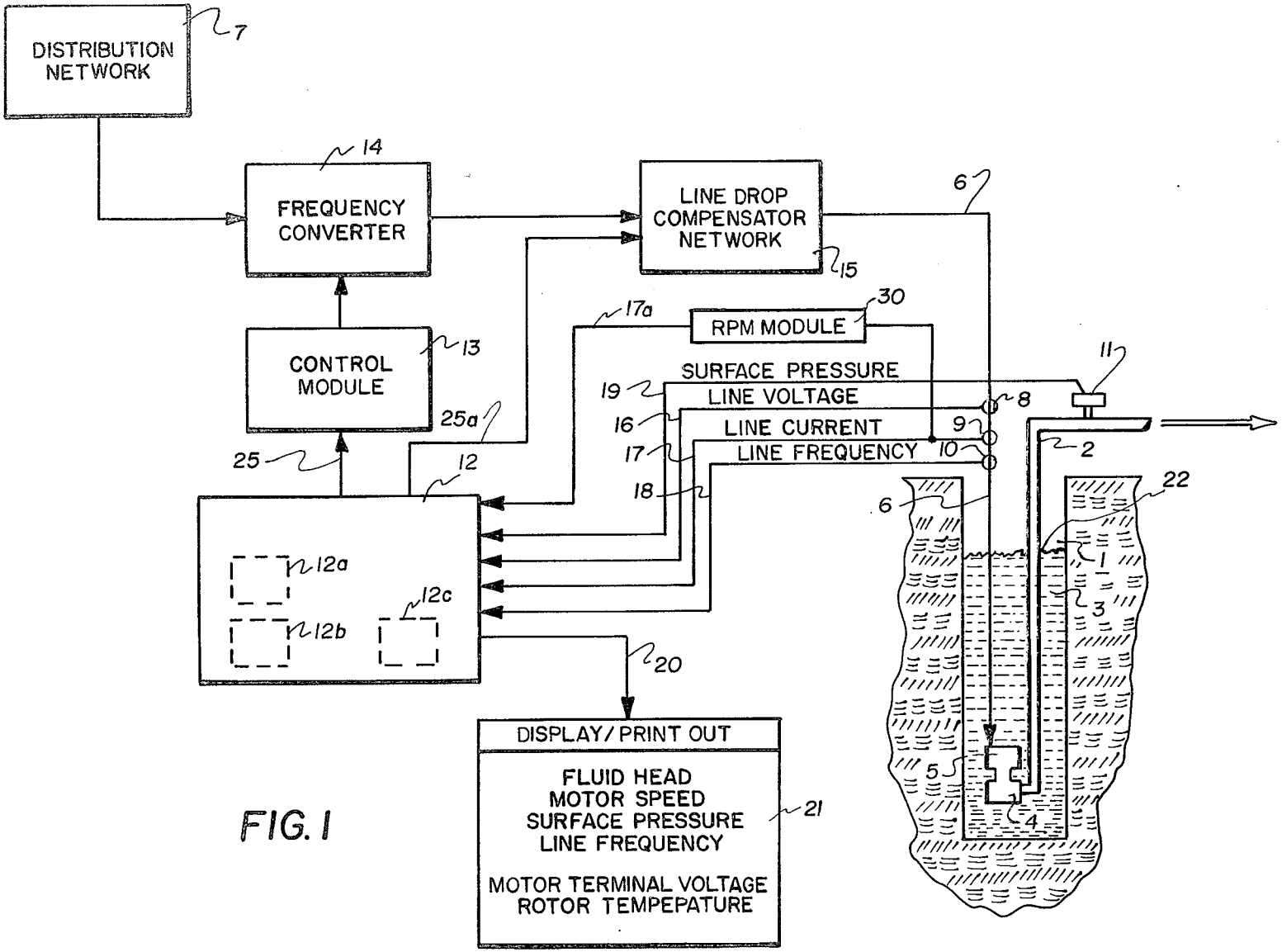
FIG. 1 is a block diagram schematic representative of the overall system of the present invention.

The basic method and system of the present invention are best described with initial reference to FIG. 1 wherein an underground well is diagrammatically depicted by the reference numeral 1, a pump 4 driven by motor 5 (normally of the induction type) effective to pump the oil 3 in the well through a conduit 2 to the surface. The conduit 2 would ordinarily form part of a conventional production unit casing, with the pump and motor normally being a single operational unit of the type conventionally used in the industry. Three-phase, 60 Hz power from a distribution network 7 is supplied to the induction motor 5 by way of suspended cable 6.

The safe and efficient production from the well 1 normally requires that the dynamic well characteristics such as variations in fluid level (head), as well as the dynamic motor characteristics, such as motor terminal voltage and rotor temperature variations during the pumping operation, be continuously monitored. Besides the safety considerations, the motor-pump combination operation can then be appropriately controlled in order to maintain the dynamic well characteristics within certain operational limits. To date, such monitoring has largely been carried out by separate sensors and transducers suspended within the well.

The basic concept of the present invention, however, eliminates the need for separately suspended downhole monitoring sensors or transducers and takes advantage of, and is based upon, the premise that there is a definable mathematical relationship between the characteristics of the well, the characteristics of the motor, and the characteristics of the pump. Thus, with the use of stored program type data processing equipment, in which such mathematical relationship is programably defined along with certain known characteristics of the particular well, motor and pump, and by putting to such data processing equipment the specific dynamic conditions conveniently monitorable at the top of the well, the dynamic on line well characteristics within the well and the dynamic on line motor characteristics not conveniently monitorable can be continuously computed. Thereafter, and in accordance with the additional unique features of the following described equipment and method, the dynamic on line well characteristics and dynamic on line motor characteristics of most concern, for example fluid head and motor terminal voltage, can be automatically controlled.

Prior to describing the system and apparatus of the present invention, it is useful, for convenience of explanation, to define certain terminology which will be utilized hereinafter in the description and claims. Accordingly, the term "fixed well characteristics" means and refers to the non-changing features or characteristics associated with the particular well (or groups of wells) being worked; and, as such, would include for example, the well geometry, geometry of the well casing, type and inherent flow characteristics and specific gravity of the well fluid, and depth of the pump. The term "dynamic on line well characteristics" means and refers to the continuously changing downhole characteristics of the well(s) during the pumping operation; and, as such, would normally include for example, the fluid level (head location), change of head with respect to time, downhole pressure, and downhole fluid temperature. The term "fixed motor characteristics" means and refers to the manufacturing specifications associated with the particular motor being used to drive the pump in the well being worked; and, as such, would include for example, stator and rotor resistance and reactance at specified temperatures and frequencies, speed-torque characteristics, power cable characteristics, etc. The term "dynamic on line motor characteristics" means and refers to the changing operating characteristics of the motor during the pumping operation; and, as such, would normally include for example, variations in rotor temperature and motor terminal voltage. The term "fixed pump characteristics" means and refers to the manufacturing specification of the particular pump being used; and, as such, would include for example, pump capacity and pump efficiency.

Referring again to FIG. 1, the heart of the monitoring and control system of the present invention is a computer 12 having memory segments 12*a* and 12*b*, the operation of the computer being controlled by a series of programs inputted and stored within a microprocessor segment 12*c*. Various types of equipment presently on the market can be used for the computer 12, one such type of equipment being the model 6800 microprocessor manufactured by Motorola Corporation of Phoenix, Arizona.

Stored within the memory section 12*a* is encoded data respectively representative of, and corresponding to, the fixed pump characteristics and the fixed motor characteristics of the pump 4 and motor 5. Similarly, stored within the memory section 12*b* is encoded data, corresponding to, and representative of, the fixed well characteristics of the particular well 1 (or group of wells). Under control of one or more of the program instructions within the microprocessor segment 12*c* which defines the pertinent mathematical operating relationship (as subsequently discussed in greater detail) between the well, motor, and pump, and responsive to variable operating conditions conveniently monitored at the top of the well, the computer 12 is effective to compute, and generate signals representative of, the desired dynamic on line well characteristics as well as the desired dynamic on line motor characteristics.

Specifically, and in accordance with the preferred operation of the system, the line voltage supplied to motor 5 is detected by way of a voltage transformer 8 inductively coupled to line 6 and a signal corresponding to the line voltage inputted to the computer 12 by way of input line 16. Similarly, the positive sequence currents flowing through motor 5 are detected from the power cable 6 by way of a conventional current transformer 9 and a signal representative of such currents inputted to the computer 12 by way of line 17. The frequency of the input power to the motor 5 is detected by an a-c frequency detector 10 and the signal proportional thereto inputted to the computer by way of line 18. The motor speed of slip can be computed by reference to the line current and line frequency data on lines 17 and 18, and RPM module 30 having its input coupled to line 6 by way of a current transformer and its output coupled to the computer by way of line, 17*a*, being utilized for such computation. Another variable inputted to the computer is a signal corresponding to the fluid surface pressure at the output of the well (derived from a conventional pressure transducer 11 coupled to the conduit 2) and such signal is inputted to the computer by way of input line 19. While not shown in the drawing, in some circumstances it might be useful to also monitor (and input to computer 12) the fluid flow rate through conduit 2, in which event a flow meter/transducer is connected intermediate the conduit and the computer.

Under the control of the program instructions within the segment 12*c*, and responsive to the changes in the signals received from the lines 16–19, and with use of the fixed well, motor, and pump characteristics derived from the memory sections 12*a* and 12*b*, the computer 12 is effective to continuously calculate any one of a variety of desired dynamic on line well characteristics, one particular dynamic on line well characteristic of maximum interest being the change in the fluid level (or head) of the oil within the well 1. In a similar manner, pertinent dynamic on line motor characteristics, such as variations in rotor temperature and motor terminal voltage, may be computed.

It is therefore to be appreciated that, with the use of the method and apparatus of the present invention, not only is it possible to continuously measure dynamic on line operating conditions which are normally only monitorable by separate downhole sensors, if at all; but that the measuring technique, in essence, utilizes the motor 5 as an instrument.

The continuous measurement of the "downhole" dynamic on line characteristics or operating conditions is effected by first determining the mathematical relationship or equation which defines each particular dynamic characteristic of interest as a function of (a) the variables being monitored at the top of the well (line voltage, line current, surface pressure, etc.) and (b) the fixed well, motor, and pump characteristics; "programming" the computer 12 by storing instructions representative of such equations in the microprocessor segment 12*c*; and storing the data representative of the fixed well, motor, and pump characteristics within read-only memory sections 12*a* and 12*b*. The computer is then ready to compute (and generate signals representative of) the particular dynamic on line characteristics in response to the monitored data received from input lines 16, 17, 17*a*, 18, and 19.

Examples of the determination of the mathematical equations for two dynamic on line motor characteristics, namely rotor temperature and motor terminal voltage, and one dynamic on line well characteristic, namely well fluid level or head, are now described.

ROTOR TEMPERATURE

As will now be described, the determination of the mathematical equation for the temperature of the rotor of the submersible motor 5 during the on line pumping operation, i.e. the dynamic rotor temperature, is effected by first defining the mathematical equation for the dynamic rotor resistance of the motor as a function of the monitored variables at the top of the well, and then defining the equation for the dynamic rotor temperature as a function of this dynamic rotor resistance. The dynamic rotor temperature is thus defined as a function of the monitored variables (as well as of the pertinent "fixed" characteristics).

In order to obtain the equation for the dynamic rotor resistance, the equivalent circuit of a polyphase induction motor (FIG. 2) is utilized as a mathematical model for calculating rotor resistance as a function of the "monitorable" parameters $I_L$ (line current) and s (slip) at ground surface. Normally, the equivalent circuit, and thus the equivalent circuit constants, of the particular motor 5 may be obtained from the manufacturer; but, if unavailable, the equivalent circuit constants of the particular motor being used may be mathematically approximated by comparing the nameplate data (horsepower rating, full load current, and operating speed) to the name plate data of a reference motor whose equivalent circuit constants are known.

Since all quantities in the equivalent circuit of FIG. 1 are referred to the stator, the stator current $I_1$ can be expressed as:

$$I_1 = I_e + I_2$$

Under balanced stead-state conditions, the line current $I_L$ monitored at the ground surface (on input line 17) is $$I_L = I_1 = I_e + I_2$$

According to known circuit theory principles (e.g. text *Principles of Alternating-Current Machinery,* Ralph R. Lawrence, McGraw-Hill, 3rd Edition, 1940) the exiting current, $I_e$, is approximately 40 percent of full-load current for a typical induction motor. Therefore, the exciting current can be expressed as a function of $I_1$, or line current $I_L$, as long as the motor is not saturated.

$$I_e = CI_L$$

The constant C, should be obtained for each submersible pump motor 5. This can be determined from lab tests or manufacturer's design data.

From the preceding equation, the rotor current $I_2$ can be determined as:

$$I_2 = I_L - I_e$$

Thus, $$I_2 = I_L - CI_L$$

$$I_2 = K_1 I_L$$

where $K_1 = 1 - C$. Therefore, $I_2$ can be calculated by monitoring the on-line value of line current, $I_L$.

According to known circuit theory principles, the internal torque $T_2$ of a motor can be expressed as follows:

$$T_2 = \frac{p}{4\pi f_1} I_2^2 \frac{r'_2}{s} \text{ newton-meters}$$

where:

$T_2$=internal torque
p=number of poles
$f_1$=line frequency
$I_2$=rotor current
$r'_2$=on-line rotor resistance at operating temperature
s=slip (function of motor rpm)

$$\text{For } K_2 = \frac{p}{4\pi f_1},\ T_2 = K_2 I_2^2 \frac{r'_2}{s} \text{ newton-meters}$$

Using a preceding equation for $I_2$ as a function of line current, the internal torque then becomes:

$$T_2 = K_2 (K_1 I_L)^2 \frac{r'_2}{s} (0.738) \text{ ft.-lbs.}$$

The constant 0.738 converts newton-meters to ft.-lbs. The dynamic rotor resistance (hereinafter referred to as $r_{2\,dyn.}$) can be expressed as:

$$r_{2\,dyn.} = \frac{s\,T_2}{K_2 K_1^2 I_L^2}$$

Since slip and line current are being monitored on line, and the constants $K_1$ and $K_2$ can be determined, the next step is to obtain the internal torque that corresponds to the monitored motor rpm (expressed as slip).

Figure 3:
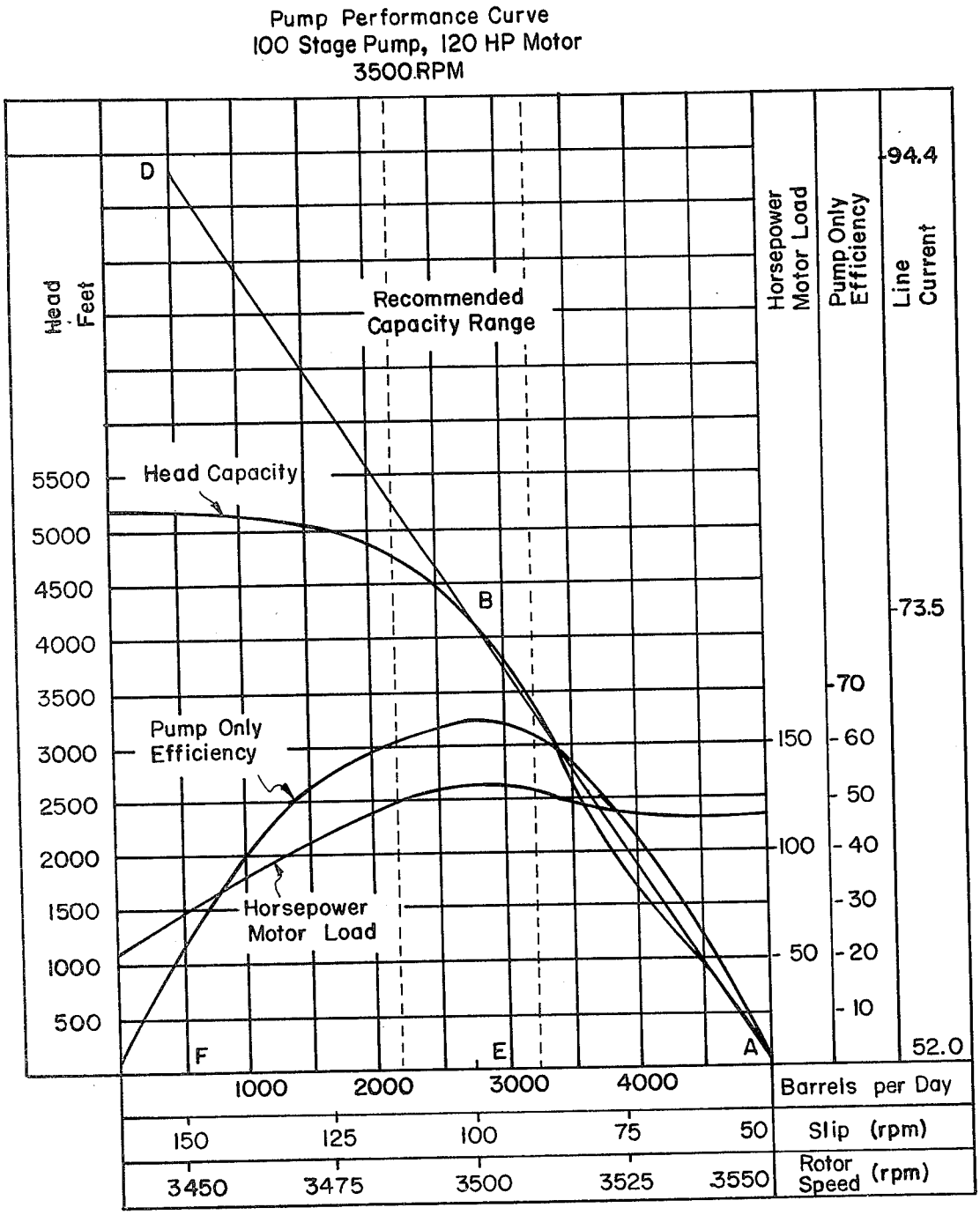

The pump performance curves in FIG. 3 show the horsepower motor load curve for a typical 120 HP motor and pump installation. The HP-slip performance data can be stored in the microcomputer memory sections that can be read as the motor speed (or slip) is monitored from supply line 6 (FIG. 1). The shaft output HP data is then used to calculate shaft output torque, $T_o$, as:

$$T_o = \frac{(HP)\,(5252)}{n} \text{ ft.-lbs.}$$

where n=motor speed in rpm.

The internal torque, $T_2$, can be calculated from:

$$T_2 = T_o + T_r$$

where $T_r$ is the torque loss due to rotation.

$$T_r = (l - s)^2 \sqrt{K_{loss}}$$

The constant $K_{loss}$ is normally supplied by the manufacturer; and for a 120 HP motor, is approximately 1800.

The value of torque, $T_2$, then is used to define the dynamic rotor resistance during dynamic on line operations, as follows:

$$r_{2\,dyn.} = \frac{s\left[\frac{HP(5252)}{n} = (l+s)^2\sqrt{1800}\right]}{K_2K_1^2I_L^2}$$

The dynamic rise in rotor temperature is then defined, by known circuit principles (e.g. text *Standard Handbook for Electrical Engineers,* A. E. Knowlton, McGraw-Hill, 7th Edition, 1941, p. 234) as a function of dynamic rotor resistance and initial rated value of rotor resistance $r_2$ init. (normally, the manufacturer's rotor resistance value at 100° C. temperature rise above 25° C. ambient) as follows:

Dynamic Rise in Rotor Temperature (above 125° C.) =

$$\left[\frac{r_{2\,dyn.}}{r_{2\,init.}} - 1\right][234.5 + (\text{Initial Temperature})]$$

where $r_{2\,dyn.}$=dynamic on line value of rotor resistance $r_{2\,init.}$=initial rated value of rotor resistance (at 125° C.)

Initial Temperature=initial rotor temperature (125° C.)

MOTOR TERMINAL VOLTAGE

The equation for the dynamic voltage of the submersible motor can also be obtained by reference to the equivalent circuit (FIG. 2) and, in accordance with known circuit theory (previous reference to Ralph R. Lawrence text, p. 484), such dynamic terminal voltage $V_1$ can be expressed as follows:

$$V_1 = \frac{I_2}{s}\sqrt{(r_1s + r_2)^2 + s^2(x_1 + x_2)^2}$$

Since, as previously determined, $I_2 = K_1I_L$ $$V_1 = \frac{K_1I_L}{s}\sqrt{(r_1s + r_2)^2 + s^2(x_1 + x_2)^2}$$

The dynamic on line value of stator resistance $r_{1\,dyn.}$ can be determined by appropriately modifying the equations previously described for calculating dynamic rotor resistance, taking into account the rotor temperature change obtained for $r_{2\,dyn.}$, thus giving the equation:

$$r_{1\,dyn.} = r_1\left(1 + \frac{\text{Dynamic Rise in Rotor Temperature above 125° C.}}{234.5 + (\text{Initial Temperature}) \text{ of } 125° \text{ C.}}\right) \quad (2.3)$$

These temperature adjusted values of stator resistance and rotor resistance ($r_{1\,dyn}$ and $r_2$ dyn) along with the known (or estimated) equivalent circuit parameters $x_1$ and $x_2$ can then be used in defining the dynamic terminal voltage as a function of the monitored variables line current and slip, as follows:

$$\underset{\text{(dynamic terminal voltage)}}{V_1} = \frac{K_1I_L}{s}\sqrt{(r_{1\,dyn}s + r_{2\,dyn})^2 + s^2(x_1 + x_2)^2}$$

WELL FLUID HEAD

Figure 4:
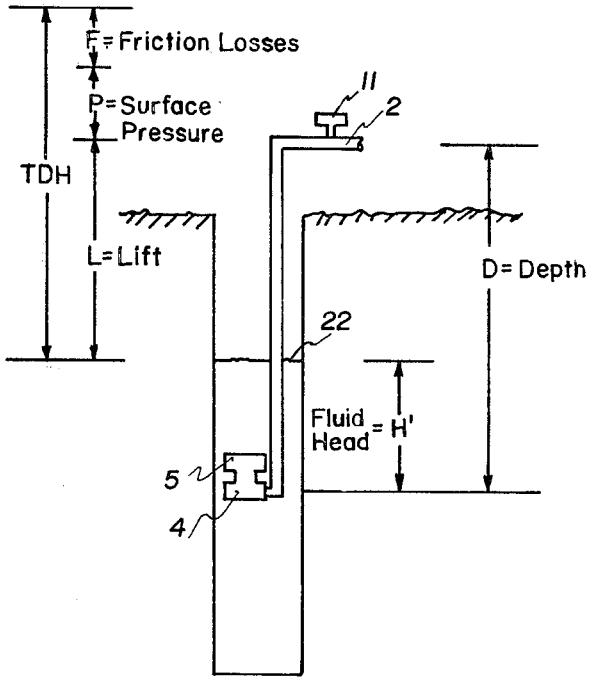
FIG. 4 is a diagrammatic representation utilized in the derivation of the mathematical relationship of the well fluid head as a function of monitored and fixed parameters.

The equation for the fluid head (diagrammatically represented in FIG. 4 as the distance H' between the fluid intake port to the pump 4 and the then-existing fluid level 22) can be obtained from initially determining its relationship to the total dynamic head (designated as TDH). The total dynamic head TDH is diagrammatically represented in FIG. 4 as consisting of the friction losses F, the surface pressure P, and the lift distance L. The total dynamic head TDH is usually expressed in head-feet if the actual lift distance is in feet; and the surface pressure consequently can also be expressed in feet by considering the specific gravity of the fluid and a proper conversion factor. Thus, the expression for TDH can be written as follows:

$$TDH = F + (P)\frac{1}{(S_g)}(2.31) + L$$

Since the lift distance can be expressed as $L=D-H'$; the total dynamic head can be:

$$TDH = F + (P)\frac{1}{(S_g)}(2.31) + D - H'$$

where:

F=Friction losses in feet (fixed well characteristic obtained from standard source, for example from the Williams and Hazen Friction Loss Tables)

P=Surface pressure in psi as measured by transducer 11

$S_g$=Specific gravity of fluid

D=Depth of pump in feet (distance between output of conduit 2 and fluid intake port to pump)

H'=Fluid head in feet

The dynamic value of fluid head can then be expressed as follows:

$$H' = F + (P)\frac{1}{(S_g)}(2.31) + D - (TDH)'$$

where (TDH)' is the dynamic on line value of the total dynamic head.

To determine the dynamic on line value of the total dynamic head, the correlation of the head-capacity curve and the speed-torque curve of the motor-pump combination should be initially determined, as now discussed, with the following discussion utilizing a numerical example to illustrate the method of finding the mathematical relationship between slip (in rpm) and capacity Q.

Figure 5:
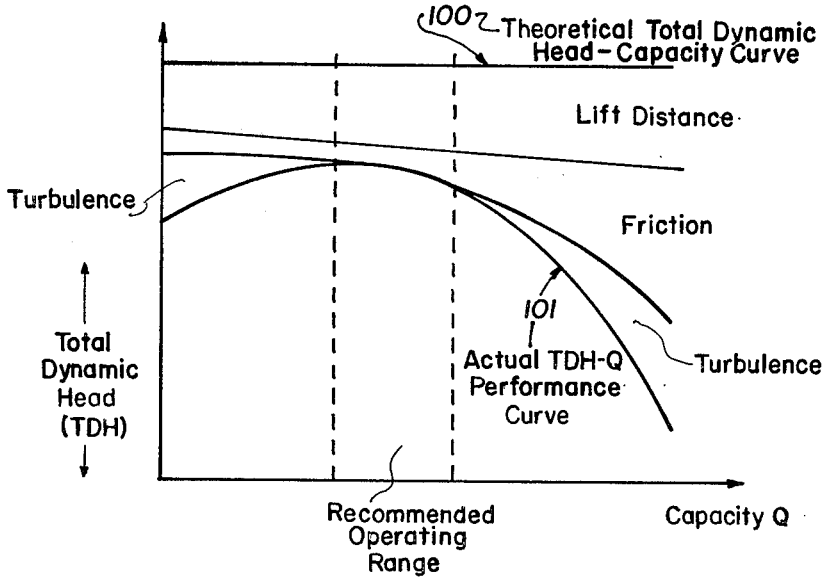
FIGS. 3 and 5 are graphs utilized in the derivation of mathematical relationships for use in practicing the method of the invention.

The head capacity curve for a given motor-pump installation gives the changes that occur in capacity Q as a result of changes in TDH. FIG. 5 shows the theoretical TDH-Q curve 100 versus the actual pump performance curve 101 of a typical submersible pump installation. The overall pump and motor combination is designed to operate in the recommended range shown. In this range of operation, certain affinity laws of centrifugal pumps and induction motors apply.

$$Q \approx n\,(1-s) \approx n$$

$$TDH \approx n^2 (1-s)^2 \approx T_o$$

$$HP \approx n^3 (1-s)^3 \approx HP$$

where

Q=Flow rate

TDH=Total dynamic head n=Rotor speed

HP=Horsepower $T_o$=Shaft output torque s=Slip

Due to the above mathematical relationships, the speed-torque curve and the head-capacity curve are essentially the same over the recommended operating ranges of the pump and motor.

Since the speed-torque curve is not usually known, an alternate method is now described to relate the n-$T_o$ curve to the TDH-Q curve, the following description based on published data in order to illustrate the method used.

The pump performance curves for a typical 100 stage pump with a 120 HP motor are shown in FIG. 3. By design, the maximum pump efficiency occurs at approximately 3500 rpm motor speed. (Slip, $s_{max.pump.eff.}$, is 100 rpm from synchronous speed of 3600 rpm.)

The 120 HP motor has a full load current of 74 amps. The exciting current, as previously described with reference to rotor temperature calculation, is approximately 40 percent of the line current. Thus, $I_e$ (FIG. 2) is approximately 30 amps when the motor is being supplied full load current.

Figure 2:
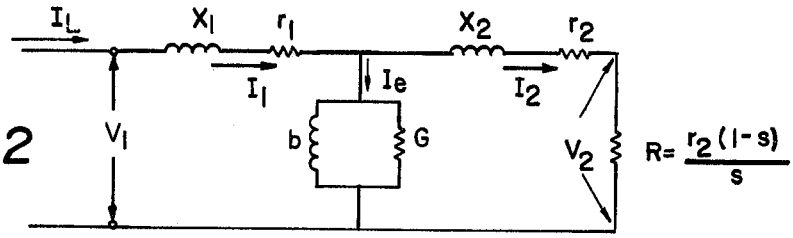
FIG. 2 is the equivalent circuit representation of a polyphase induction motor utilized in the derivation of mathematical relationships for use in practicing the method of the invention.

$I_2$, the rotor current in the equivalent circuit of FIG. 2, can be calculated from $I_2=I_L-I_e=74-30+44$ amps. Thus, at 3500 rpm, $$I_L=74 \text{ amps } I_e=30 \text{ amps}$$

$$I_2=44 \text{ amps } s=100 \text{ rpm}$$

For a constant terminal voltage on the motor, $I_2$ (rotor current in equivalent circuit of FIG. 2) varies directly with slip s. Let $$s/I_2=k_1$$

for s=100 rpm and $I_2$=44 amps, $k_1$=2.2727

By making a reasonable assumption of slip=50 rpm (n=3550 rpm) at point A on FIG. 3, the corresponding current $I_2$ can be calculated.

$$s/I_2=k_1$$

$$50/I_2=2.2727$$

$$I_2=22 \text{ amps}$$

Similarly, for s=150 rpm, $I_2$ is found to be 66 amps.

From motor theory discussed previously, line current varies with the square root of slip. This can be observed by plotting the line current, $I_L$, versus slip on the pump performance curves in FIG. 5. At point A on FIG. 3, the line current can be determined from $$I_L=I_e+I_2$$

where $I_e$=30 amps and $I_2$=22 amps. Thus $I_L$=52 amps at point A. Other values of $I_L$ can be calculated using the method mentioned above to determine the constant $k_2$.

$$I_L = k_2 \sqrt{s}$$

For $I_L$=52 amps and slip=50 rpm, $k_2$=7.354

For slip=100 rpm, $$I_L = 7.354 \sqrt{100}$$

$$I_L = 73.5 \text{ amps}$$

This value is shown at Point B on FIG. 3 and corresponds to the full load ampere rating (74 amps) of the motor as expected. For slip=150 rpm, $I_L$=90.07 amps as compared to the value of 94.4 graphically obtained at Point D on FIG. 3.

The straight line (points A, B, D) represents the line current versus slip for the motor only. The straight line is only an approximate of the actual curve of $I_L$ versus $\sqrt{\text{slip}}$. This approximation serves as a load line that identifies the theoretical limits of operation. This curve line differs from the Head-Capacity curve due to the shape of the Pump Only Efficiency curve and the Horsepower Motor Load curve.

If the above assumption of slip=50 rpm at Point A had given invalid results (such as full load current calculated at point B being different from 74 amps), a different value of slip should be tried until satisfactory results are obtained.

Next, the mathematical relationship between slip (in rpm) and Q can be obtained. The change is capacity, Q, varies with slip according to a constant:

$$\frac{Q_A - Q_F}{s_F - s_A} = k_3$$

where $k_3$ is in terms of flow rate per slip (in rpm from synchronous speed). Subscripts A and F are operating points on the Q axis of FIG. 3.

Constant, $k_3$, can be calculated by substituting values for FIG. 3 into the preceding equation. Thus, $$k_3 = \frac{(675 - 125\ BPD)}{(150 - 50) \text{ rpm slip}}$$

$$k_3 = 5.5\ BPD/\text{rpm slip}$$

This constant can be used to calculate the corresponding value of Q for monitored values of rotor speed (n in rpm). Slip in rpm can be calculated from:

$$S_{rpm}=n_{sync.\ rpm}-n_{monitored\ rpm}$$

For example, assume the monitored rpm at line 17*a* (FIG. 1) is 3480. The rpm slip is $$S_{rpm}=3600-3480$$

$$S_{rpm}=120 \text{ rpm}$$

Since $Q_A=k_3\ (s_F-s_A)=Q_F$, this equation can be solved for $Q_A$ (letting point A be 3480 rpm) as follows:

$$Q_{3490}=k_3\ (s_F-S_{3490})+Q_F$$

$$Q_{3490}=5.5\ (150-120)+125$$

$Q_{3490}=290$ BPD

The results of the above numeric example can then be verified graphically on FIG. 2.

The TDH-Q curve (as shown in FIG. 5) can then be stored in the memory sections of computer 12. The on line dynamic rotor speed is computed from the data received from line 6 (FIG. 1) and used to calculate the corresponding value of Q; and the corresponding value of TDH is read from the stored data table. This TDH reading thus corresponds to the dynamic on line value (TDH)' in the previously described equation:

$$H' = F + (P)\frac{1}{(S_g)}(2.31) + D - (TDH)'$$

resulting in a signal being generated by computer 12 representing the dynamic value of the then-existing well fluid head.

The various detected conditions and computed dynamic conditions can thereafter be outputted by way of output line 20 for visual display or hard copy printout, such display and printouts being diagrammatically depicted at 21. In accordance with unique features of the present invention, however, one of the computed dynamic on line well characteristics, namely the change of head within the well, is also utilized as a control signal 25 for varying the speed of motor 5 for the purpose of maintaining an essentially constant fluid level within the well 1. Additionally, one of the computed dynamic on line motor characteristics, namely the motor terminal voltage (previously referred to as $V_1$), is also utilized as a control signal 25*a* to maintain an essentially constant motor terminal voltage, as subsequently described. Specifically, for the former purpose, a frequency converter 14 is coupled to the output of the distribution power network 7 and, responsive to a control module 13 coupled between an output from the computer 12 and an input to the frequency converter 4, is effective to alter the frequency of the power supplied to the motor 5 as a function of the change of head (or fluid level). As subsequently described in greater detail, a DC voltage signal 25 is generated by the computer 12 and inputted to the control module 13, the magnitude of the DC signal being proportional to the change of the fluid level 22 of the oil 3 within the well 1 above the intake port (not shown) of the pump 4. The control module 13, being responsive to this signal, correspondingly actuates the converter 14 to either increase or decrease the frequency of the power supplied to the motor 5, thereby correspondingly increasing or decreasing the speed of the pump motor, as the case may be. Thus, when the fluid level begins to drop, this condition is computed and sensed by the computer 12, resulting (after a slight delay) in the generation of a DC signal which causes the frequency converter 14 to decrease the frequency of the power supplied to the motor, thus reducing the pumping rate to reduce the rate of drop of the fluid level. Similarly, a corresponding increase in the fluid level will result in a control signal being generated to the module 13 to cause the frequency converter 14 to increase the frequency of the power supplied to the motor, thus increasing the speed of the pump motor 5 and the pumping operation, thereby reducing the fluid level to the desired point. It is thus observed that the system provides a feedback control system effective to maintain the fluid level at the desired point, i.e. at a constant level or at least a minimum distance above the pump intake port.

For the purpose of maintaining constant motor terminal voltage, a line drop compensator network 15, the details and operation of which are subsequently described, is coupled intermediate the output of the frequency converter 14 and the input to the motor 5, the signal 25*a* being utilized as a closed loop feedback control signal to maintain an essentially constant motor terminal voltage. This not only maintains a more efficient operation of the motor-pump combination, but also tends to simplify the stored mathematical relationship within the computer 12.

Figure 6:
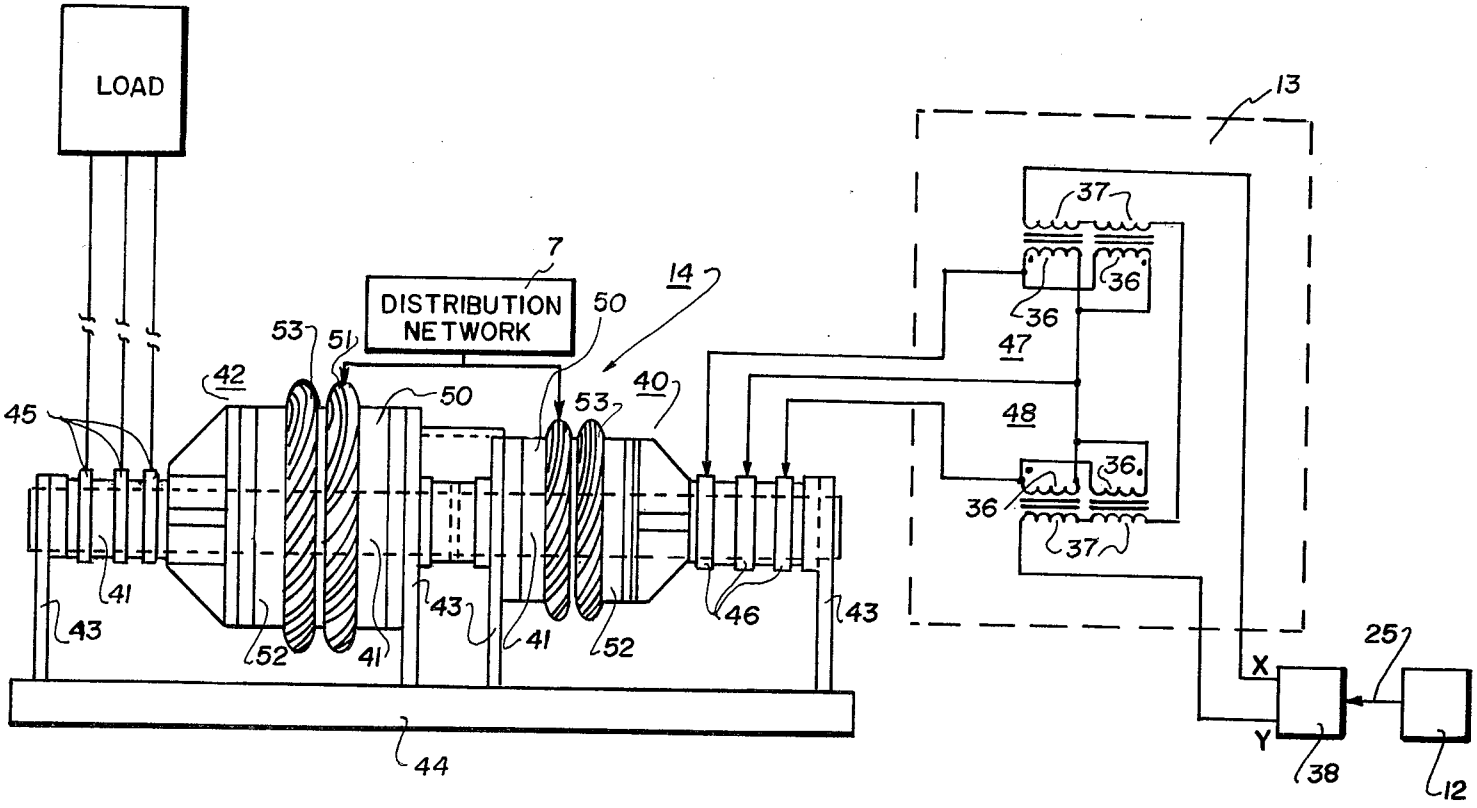
FIG. 6 is a schematic illustration of a preferred embodiment of frequency control apparatus in accordance with the invention.

Referring now to FIG. 6, there is now described a preferred embodiment of the frequency converter 14 and control module 13 for effecting the alteration of the frequency of the power supplied to the submersible motor. Accordingly, the frequency converter 14 includes a prime mover stage 40 mechanically coupled by way of rotatable shaft 41 to a converter stage 42, the entire assembly mounted by brackets 43 to a support 44. Each of the stages 40 and 42 essentially constitutes a rotating coplanar alternating current machine comprising a stator 50 (with stator windings 51) and a rotor 52 (with rotor windings 53). Both the rotor of the prime mover stage 40 and the rotor of the converter stage 42 are connected to, and adapted to simutaneously rotate with, the common shaft 41.

A first set of rotor slip ring 45 electrically connected in the rotor circuit of convertor stage 42 in the manner conventionally known in the art is disposed at one end of the rotatable shaft 41 (as illustrated in FIG. 6). Thus, three phase power supplied from the output of the distribution network 7 to the prime mover and convertor stages (for example, to the stator windings thereof) consequently results in power being supplied (by way of slip rings 45) to the load which, in this instance, would be to the submersible motor 5 by way of the line drop compensator network 15. Without the control feature now to be described, the frequency of the a-c power supplied to the load from slip rings 45 would be the frequency of the power supplied by the distribution network 7, normally 60 Hz.

In accordance with the unique feature of the present invention, however, the prime mover is driven in a manner which will alter (increase or decrease) the frequency of the power supplied to the motor from that supplied by the network 7. As an example of one way of effecting such result, a second set of rotor slip rings 46 electrically connected in the rotor circuit of the prime mover stage 40 is disposed at end of shaft 41 opposite that of the rings 45 and are electrically connected with the control module 13.

The control module 13 comprises a pair of saturable core reactors 47 and 48, each saturable core reactor comprising parallel connected a-c load windings 36 and a pair of series-connected d-c control windings 37. As depicted in FIG. 6, the outputs from the saturable core reactors 47 and 48 are connected across the slip rings 46, the reactors 47 and 48 thus, in effect, constituting a variable impedance network in the rotor circuit of the prime mover stage. It is believed apparent that by varying the magnitude and polarity of the d-c voltage across the d-c control windings 37, the a-c impedance of the saturable core reactors 47 and 48 (and thus of the rotor circuit of the prime mover stage) may be appropriately adjusted.

The d-c voltage across the control windings 37 is supplied at the output terminals X and Y of a module 38, the module 38 normally including a conventional d-c power supply (the magnitude of which is regulated by the magnitude of the d-c signal 25 from the output of the computer 12) and a conventional reversing switch for changing the polarity of the d-c signal across the output terminals X and Y.

The overall operation of the frequency converter 14 and control module 13 are now described. It is initially assumed that the fluid head is at the desired level with the frequency of the power supplied to the motor being at the same frequency, 60 Hz, as that of the power supplied from the distribution network. As the fluid level (or head) increases above the desired point, the magnitude of the signal 25 from the computer 12 increases, thus altering the magnitude of the d-c voltage across output terminals X and Y of the module 38 to decrease the effective a-c impedance of the saturable core reactors, thus increasing the rate of rotation of the shaft 41 and the consequent increase of the frequency of the power supplied to the motor 5 from the slip rings 45.

Similarly, when the fluid level or head drops below the desired point, the consequent reduction of the level of the d-c signal 25 from the computer 12 reverses the polarity of the d-c voltage at the terminals X and Y, resulting in the shaft 41 being driven in the opposite direction, thus decreasing the frequency of the power supplied to the load (i.e. motor 5). Thus, it will be seen that the increased rate of rotation of the shaft 41 in its normal direction of rotation will cause an increase of the frequency of the power supplied to the motor; while the rotation of the shaft in the opposite direction will essentially reduce the frequency of the power supplied to the motor below that frequency of the power being supplied by the distribution network 7.

Figure 7:
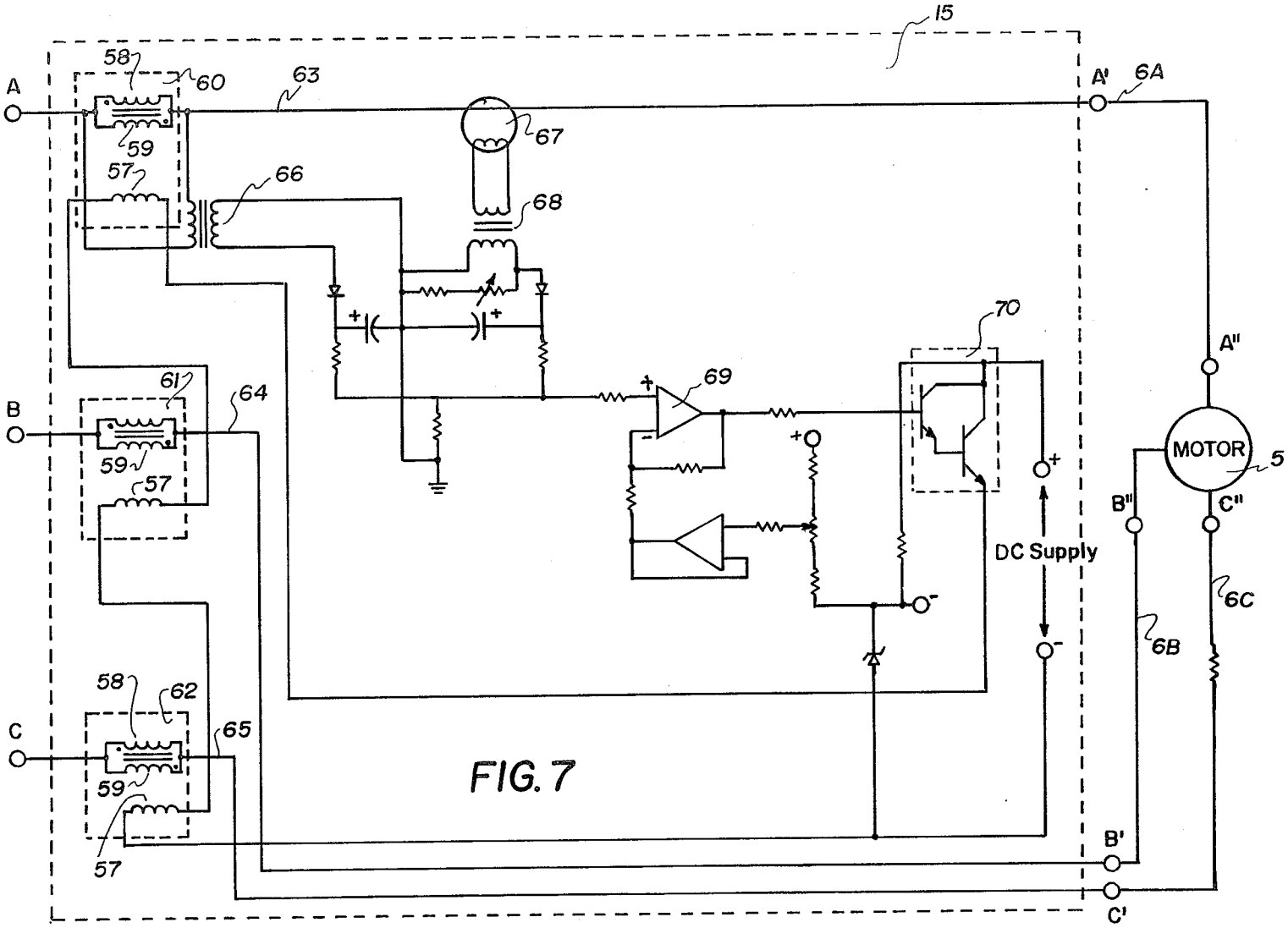
FIG. 7 is a schematic illustration of a preferred embodiment of line drop compensator apparatus in accordance with the invention.

Referring to FIG. 7, there is now described the unique design and operating features of the line drop compensator network 15. The compensator network 15 is provided intermediate the output of the frequency convertor 14 and the submersible motor 5 in order to maintain a constant terminal voltage across the terminals A″, B″, and C″ of the motor 5. Without such compensation, and due to the effectively large resistance of the long downhole power cable 6 (represented in FIG. 7 by each of the three phase lines 6A, 6B, and 6C), variations in the line conditions, and particularly changes in the thermal conditions in the well resulting in effective changes in the power cable resistance, result in fluctuations in the motor terminal voltage. In accordance with the design and operation of the line drop compensator network 15, however, the voltage is maintained at the output terminals A′, B′, and C′ of the network 15 in a manner which maintains essentially constant motor terminal voltage.

The compensator network 15 comprises a set of variable impedance elements 60, 61, and 62 respectively connected in each of the supply lines 63, 64, and 65. In accordance with a preferred embodiment of the inventive network, each of the variable impedance elements is provided by a saturable core reactor of the type generally known in the art comprising parallel connected a-c load windings 58 and 59 and a d-c control winding 57. The saturable core reactors operate in the manner known to those skilled in the art, namely the variation of the d-c voltage across each d-c control winding 57 varies the a-c impedance of the load windings 58 and 59, thus altering the overall a-c impedance in the supply lines 63, 64, and 65. The d-c control windings 57 are all connected in series so that variation of the d-c current flowing through one of the control windings, as subsequently described, will result in simultaneous adjustments being effected to the impedance elements 60–62.

The voltage drop across the a-c load windings of the saturable core reactor variable impedance element 60 is detected by a potential transformer 66; and the current in the supply line 63 is detected by a current transformer 67, a voltage proportional to such current being generated by the potential transformer 68. The combination of the voltages from the transformer 66 and 68 are than supplied (by way of the circuitry shown) to the noninverting input of a voltage comparator 69, a reference voltage being supplied to the comparator by way of the inverting terminal thereof. The output of the voltage comparator is then coupled to the input of a transistor drive network 70, the output of which is coupled to the d-c control winding 57 of the variable impedance element 60.

In accordance with the overall operation of the network 15, a d-c bias is normally supplied to the d-c control windings 57, thus maintaining the impedance of the variable impedance elements 60–62 at an initial desired value. If the current in lines 6A, 6B, and 6C increases, the resulting conditions will be sensed, producing a voltage at the output of the comparator 69 to drive the transistor drive network 70 in a manner which will after the d-c current to the control windings 57 to decrease the overall impedance presented by the elements 60–62, thus reducing the voltage drop between A to A′, B to B′, and C to C′. Similarly, a drop in the current in lines 6A, 6B, and 6C will result in an increase of the impedance presented by the impedance elements 60–62, thereby to increase the voltage drop between A-A′, B-B′, and C-C′. Thus, it will be observed that the motor terminal voltage at the terminals A″, B″, and C″ will remain essentially constant notwithstanding fluctuations in the conditions in the lines 6A, 6B, and 6C.

The line drop compensator network 15 can also be utilized as part of a closed loop feed back control system for directly maintaining a constant motor terminal voltage. Specifically, and as previously described, the signal **25*a* (FIG. 1) represents the computed dynamic on line value of the motor terminal voltage during the pumping operation. By utilizing this signal as one input to the comparator 60, for example the noninverting input, which is then compared to a reference voltage at the other input representing the desired motor terminal voltage (for example, the nameplate voltage of motor 5 at the specific frequency); the "difference" voltage will then adjust the impedance of the variable impedance elements 60–62** to maintain the desired motor terminal voltage.

Various modifications to the disclosed embodiments, as well as alternate embodiments, may become apparent to one skilled in the art without departing from the spirit and scope of the invention as defined by the appended claims.

What is claimed is:

1. In a well pumping operation of the type including a motor driven pump submerged within, and for pumping, the well fluid within a well, a conduit in fluid communication with the pump and extending to the top of the well, and a suspended cable extending into the well for supplying electrical power to the motor driving the pump, a system for monitoring and controlling the dynamic on line operating conditions of said well pumping operation, said system comprising:

(a) stored program computer means having memory segments respectively containing encoded data representative of at least one of the fixed characteristics of the motor, pump, and well;

(b) means coupled to said cable at the surface of the well for generating data signals representative of at least one characteristic of the power being supplied to the motor;

(c) program means within said computer defining the mathematical relationship between a dynamic on line operating condition as a function of the said at least one fixed characteristic and the said at least one power characteristic; and (d) means under the control of said program means for generating signals continuously representative of said dynamic on line operating condition in response to the receipt by said computer means of said data signals.

2. The system as defined by claim 1 wherein said means coupled to said cable generates data signals representative of the line current and frequency of power being supplied to said motor.

3. The system as defined by claim 1 wherein said dynamic on line operating condition is the fluid level within the well.

4. The system as defined by claim 1 wherein said dynamic on line operating condition is the motor terminal voltage.

5. The system as defined by claim 1 further including means coupled to said conduit for generating data signals representative of the fluid surface pressure at the output of the well.

6. In a well pumping operation of the type including a motor driven pump submerged within, and for pumping, the well fluid within a well, a conduit in fluid communication with the pump and extending to the top of the well, and a suspended cable extending into the well for supplying electrical power to the motor driving the pump, a system for monitoring and controlling the change in the fluid level in the well during said well pumping operation, said system comprising:

(a) stored program computer means having memory segments respectively containing encoded data representative of the fixed characteristics of the motor, pump, and well;

(b) means coupled to said cable at the surface of the well for generating first data signals representative of the motor rpm and characteristics of the power being supplied to the motor;

(c) means coupled to said conduit for generating second data signals representative of the fluid surface pressure at the output of the well;

(d) program means within said computer defining the mathematical relationship of the change in fluid level in the well as a function of the said fixed characteristics and the said first and second data signals;

(e) means under the control of said program means for generating third signals continuously representative of the fluid level within the well in response to the receipt by said computer means of said first and second data signals; and (f) means responsive to said third signals for varying the rpm of the motor, thereby to regulate the fluid level within the well.

7. The system as defined by claim 6 wherein said means for varying the rpm of the motor comprises means for altering the frequency of the power supplied to the motor as a function of the change in said fluid level.

8. The system as defined by claim 7 wherein said rpm varying means comprises:

(a) a first rotating alternating current machine comprising stator and rotor windings disposed intermediate the source of power for the motor and the motor;

(b) a second rotating alternating current machine connected with, and for rotatably driving, said first machine; and (c) means responsive to said third signals for altering the magnitude and direction of the rotation of said second machine, thereby to alter the frequency of the power supplied to the motor.

9. The system as defined by claim 8 wherein said means responsive to said third signals comprises variable impedance means, which impedance is varied in response to said third signals.

10. In a well pumping operation of the type including a motor driven pump submerged within, and for pumping, the well fluid within a well, a conduit in fluid communication with the pump and extending to the top of the well, a power distribution network, and a suspended cable extending into the well for supplying electrical power from said power distribution network to the motor driving the pump, a system for monitoring and controlling the terminal voltage of the motor during said well pumping operation, said system comprising:

(a) stored program computer means having memory segments respectively containing encoded data representative of the fixed characteristics of the motor, pump, and well;

(b) means coupled to said cable at the surface of the well for generating first data signals representative of the motor rpm and characteristics of the power being supplied to the motor;

(c) program means within said computer defining the mathematical relationship of the motor terminal voltage as a function of the said fixed characteristics and the said first data signals;

(d) means under the control of said program means for generating second signals continuously representative of the changes in the motor terminal voltage in response to the receipt by said computer means of said first data signals; and (e) line drop compensator means responsive to said second signals for varying the voltage supplied to the cable, thereby to regulate the motor terminal voltage during the pumping operation.

11. The system as defined by claim 10 wherein said line drop compensator means comprises variable impedance means disposed intermediate the power distribution network and said suspended cable, and means for varying the impedance of said variable impedance means in response to said second signals.

12. The system as defined by claim 11 wherein said variable impedance means are saturable core reactors and the second signals are effective to alter the overall a-c impedance of the a-c load windings of said saturable core reactors.

13. The system as defined by claim 12 further comprising means responsive to current in, and voltage across, the said a-c load windings to alter the impedance of said variable impedance means.

14. A system for monitoring and controlling the dynamic operating conditions of events occurring at a location normally inaccessible to direct measurement said system comprising:

(a) first means providing communication between said inaccessible location and an accessible location;

(b) stored program computer means having memory segments respectively containing encoded data representative of fixed characteristics at said inaccessible location;

(c) means coupled to said first communications means at said accessible location for generating first data signals representative of the status of conditions occurring in said first communication means;

(d) program means within said computer defining the mathematical relationship between a dynamic operating condition as a function of the conditions occurring in said first communication means and said fixed characteristics; and (e) means under the control of said program means for generating signals continuously representative of said dynamic operating condition in response to the receipt by said computer means of said first data signals.

15. In a well pumping operating of the type including a motor driven pump submerged within, and for pumping, the well fluid within a well, a conduit in fluid communication with the pump and extending to the top of the well, and a suspended cable extending into the well for supplying electrical power to the motor driving the pump, a method for monitoring and controlling the dynamic on line operating conditions of said well pumping operation, the method comprising:

(a) defining the mathematical relationship between a dynamic on line operating condition as a function of the fixed characteristics of the motor, pump and well and at least one characteristic of the power being supplied to the motor;

(b) storing information within a computer representative of said fixed characteristics;

(c) storing instructions in said computer representative of said mathematical relationship; and (d) generating signals continuously representative of said dynamic on line operating conditions in response to the receipt by said computer of data signals representative of monitored power characteristics.

* * * * *